United States Patent [19]

Das et al.

[11] 4,391,652

[45] Jul. 5, 1983

[54] SURFACE TREATMENT FOR ALUMINUM AND ALUMINUM ALLOYS

[75] Inventors: Narayan Das, Westmont; Joy M. Schaefer, Park Ridge, both of Ill.

[73] Assignee: Chemical Systems, Inc., Chicago, Ill.

[21] Appl. No.: 343,992

[22] Filed: Jan. 29, 1982

[51] Int. Cl.[3] ..... C23F 7/00

[52] U.S. Cl. ..... 148/6.15 R; 148/6.27

[58] Field of Search ..... 148/6.27, 6.14 R, 6.15 R

[56] References Cited

U.S. PATENT DOCUMENTS

| | | | |
|---|---|---|---|
| 3,682,713 | 8/1972 | Ries | 148/6.27 |
| 4,273,592 | 6/1981 | Kelly | 148/6.27 |
| 4,370,177 | 1/1983 | Fielin | 148/6.27 |

*Primary Examiner*—Sam Silverberg

*Attorney, Agent, or Firm*—Hosier, Niro & Daleiden

[57] ABSTRACT

A low pH solution and a method for conversion coating aluminum and aluminum alloy surfaces, as well as the coated surfaces themselves, utilizing zirconium, fluoride and nickel and, optionally, fluorophosphate.

15 Claims, No Drawings

SURFACE TREATMENT FOR ALUMINUM AND ALUMINUM ALLOYS

BACKGROUND OF THE INVENTION

This invention relates generally to a solution and a method for coating aluminum and aluminum alloy surfaces. More particularly, this invention relates to a solution and a method for the conversion coating of aluminum and aluminum alloy surfaces as well as the unique coated surfaces produced thereby to prevent corrosion and to improve adhesion to overlying paints, inks, lacquers and plastic coatings.

Aluminum and aluminum alloy conversion coatings are typically applied to sheet and roll stock which is formed into a wide variety of different shapes for applications ranging from architectural to canning. In all of these applications, it is important that the conversion coatings be thin and even, and capable of very rapid application. These coatings should also adhere well to both the underlying metal and the overlying coating.

The conversion coatings must be capable of protecting the underlying aluminum from attack by corrosive agents in the environment including water and water vapor. The coating should also be sufficiently flexible and elastic to enable the coated metal to be formed into the desired shapes without cracking the conversion coating and adversely affecting both the appearance of the overlying coating and the corrosion resistance of the overall product.

In many applications, such as in the coating of aluminum cans, it is important that the conversion coatings be clear and colorless in order to preserve the natural appearance of the aluminum. Coated aluminum cans must also have the ability to resist discoloration when they are heated during processing of the cans at temperatures up to 175° F.

While coating compositions and methods are known for producing aluminum and aluminum alloy conversion coatings having the required and desired properties, the use of these compositions and methods or the nature of the conversion coatings which they produce have had shortcomings. For example, until recently the most popular and effective materials used for producing aluminum and aluminum alloy conversion coatings contained chromates and/or ferricyanides, both of which are highly toxic and therefore extremely difficult to handle and environmentally very undesirable. Alternative coating compositions, while generally free of the handling and enviromental difficulties, produce conversion coatings which are poorly adherent, porous or deficient in some other respect. As a result, there has been a very significant impetus to those working in this art to develop coating compositions and methods which are safe to use, yet produce coatings equal to or better than those formerly obtained with chromates or ferricyanides.

For example, U.S. Pat. No. 3,682,713 describes a process for treating aluminum and other metals with a chromate free solution containing fluorides of boron, titanium, zirconium or iron, free fluoride ions and oxidizing agents. These treating solutions optionally also include metal salts which form insoluble oxides of the coating such as the water-soluble salts of zinc, nickel, cobalt and trivalent chromium.

Although this patent generally describes a pH range of 3.0–6.8 and a treatment time range of 3 to 180 seconds, the examples of the patent reflect a working minimum pH of 4.3 and a working minimum treatment time of 20 seconds, which respectively adversely affect the corrosion resistance of the conversion coating produced and slow the overall coating process.

U.S. Pat. No. 3,964,936 which issued to one of the present inventors, reflects yet another chromate ferricyanide free coating solution. This solution contains zirconium, a fluoride source, and, optionally, boron and specifically excludes manganese, cobalt, iron and nickel. The coating solution of this patent is designed to operate in a pH range of about 3 to about 5 and at a minimum contact time of about 15 seconds.

U.S. Pat. No. 4,148,670 describes yet another aluminum coating solution. This solution contains zirconium and/or titanium, fluoride and phosphate. As in the case of the '936 patent referred to above, this patent stresses that the claimed solution is capable of effectively forming coatings on aluminum in the absence of elements such as manganese, iron, cobalt, nickel, etc. Also, while this patent describes a pH range of about 1.5 to about 4.0 and preferably about 2.6 to about 3.1 and a contact time of at least about 5 seconds and preferably 15 seconds, the examples illustrate a working pH of at least 2.5 and a contact time of about 25 seconds.

U.S. Pat. No. 4,273,592, which issued to the same inventor and assignee as the above '670 patent, contains as essential ingredients a zirconium and/or a hafnium compound, a fluoride compound and a polyhydroxy compound having no more than seven carbon atoms. The pH of this coating solution is about 3.0 to about 5.0 and preferably about 3.0 to about 4.0. However, this patent goes on to teach that a preferred treatment solution will have a pH in the range of about 3.0 to about 4.0, and the examples utilize a minimum pH of 3.5. Also, this patent specifically requires that the coating solution be free of boron and phosphate.

Furthermore, the above solution requires 20 seconds' contact time to produce the desired coating. It is therefore not capable of forming effective coatings in the less than five seconds' contact time permitted in many modern rapid coating systems. For example, this solution could not be used in high speed coil lines which may permit only five seconds' contact time.

Finally, U.S. Pat. No. 4,277,292 discloses a conversion coating solution utilizing zirconium and fluoride ions in combination with tannin and operating at a pH between 2.3 and 2.95. This patent explains that its low pH bath is preferable to prior titanium/fluoride/tannin baths because it avoids acid depletion and precipitation. However, unfortunately, this patent claims that the coating solution requires 30 seconds' of contact time to produce the desired coating. Therefore, as in the above '592 patent, this solution is not capable of forming effective conversion coatings in the much shorter contact times permitted in many systems. In addition, it should be noted that the solutions of this patent exclude the use of phosphates.

While the conversion coating solutions and methods of the above patents offer useful alternatives to the prior chromate and ferricyanide based systems, they leave much to be desired. For example, the zirconium fluoride complexes produced by the solutions of these prior patents often exhibit inferior adherence characteristics in the conversion coating. In addition, these prior solutions often require excessive coating reaction times which slow down automated aluminum processing lines. Also, in systems such as that described in the above '670 patent, the levels of zirconium and fluoride ions must be maintained in a very delicate balance in order to avoid precipitation of insoluble zirconium phosphate, which would deplete the coating solution of two of its required components. Finally, all of the above prior arts do not actually provide secondary cleaning or removal of smut products caused by the alkaline cleaning operation often necessary on high speed coil lines to achieve superior adhesion characteristics.

The coating solution and method of the present invention utilize zirconium and fluoride in combination with certain other ions including nickel to produce a conversion coating with outstanding corrosion resistance and adhesion. This coating can be produced extremely rapidly, and without sacrificing the required clarity, colorlessness, resistance to darkening when subjected to boiling water, and elasticity. The coating solution of the present invention is also capable of providing secondary cleaning action.

DETAILED DESCRIPTION OF THE INVENTION

The conversion coating of the present invention can be applied to pure aluminum or alloys of aluminum including alloys of aluminum with minor amounts of magnesium, manganese, copper and silicon. Although these conversion coatings can be used in a wide variety of applications, they are expected to become particularly important in the manufacture of aluminum cans and aluminum strip including rigid container stocks, beer and beverage end stocks, architectural and building products, and extrusions.

The coating solutions of the present invention contain as essential ingredients a source of zirconium ions, a source of fluoride ions, and a source of nickel ions. The solution also preferably contains a fluorophosphate compound and a wetting agent such as glucoheptonate. The pH of the solution should be maintained in the range of about 1.2 to about 3.0, preferably in the range of about 1.5 to about 2.5, and most preferably in the range of about 1.5 to about 2.0.

The zirconium ion may be introduced into the coating solution in the form of soluble zirconium salts such as zirconium fluorides, sulfates, nitrates or carbonates. Examples of these compounds include zirconium acid sulfate, sodium hexafluorozirconate, potassium hexafluorozirconate, ammonium hexafluorozirconate, zirconium nitrate, and zirconium carbonate. Another acceptable source of zirconium would be the metallic fluoride, zirconium fluoride.

It is well recognized that the zirconium present in the coating must be either directly or indirectly bonded to the aluminum surface in order to produce a satisfactory conversion coating. In the practice of the present invention, the level of zirconium in the coating solution must be at least about 0.025 grams/liter, and preferably at least about 0.080 grams/liter to achieve the desired bonding to the aluminum surface.

The concentration of zirconium ion in the concentrate from which the coating solution will be made up may range up to the solubility limit of the zirconium compound being utilized. This solubility limit in the concentrate will depend not only upon the compound itself, but also upon the actual acidity of the solution and the quantity of fluoride present. In the coating solution, however, the range of zirconium ion must not exceed 0.150 grams/liter and more preferably it should not exceed 0.0120 grams/liter.

The precipitation of zirconium compounds such as zirconium oxide from the coating solution should be avoided. Such precipitation depletes essential components in solution and may result in the deposition of unacceptable conversion coatings. Zirconium compound precipitation is minimized in the practice of the present invention by maintaining a very acidic pH range and, in a preferred embodiment, by utilizing fluorophosphate compounds which form stable complexes with the zirconium, as will be explained in further detail below.

Fluoride ions are introduced into the coating solution in free and/or complex forms. These include hydrofluoric acid and salts thereof, alkali metal and ammonium fluorides, complex fluorides like fluoborate salts and acids, alkali metal and ammonium bifluorides and any other fluoride containing compound which is soluble in the solution and does not carry with it undesirable ionic species.

The level of fluoride ion in the bath is dictated by a number of factors. First, there must be sufficient fluoride ion present to combine with the zirconium ions to produce a stable complex. For this purpose, at least about four moles of fluoride per mole of zirconium must be present and preferably at least about six moles of fluoride per mole of zirconium will be provided. In practice, the fluoride ion level will be at least about 0.050 grams/liter and preferably at least about 0.100 grams/liter.

In addition to forming stable complexes with zirconium, the fluoride ions must also be available for complexing aluminum which is dissolved from the surface being coated during the coating process. For this purpose, the mole ratio of fluoride ion to aluminum metal should be at least about 3:1 and preferably an excess above this ratio of about 100 ppm of fluoride ion will be used.

Since too great an excess of free fluoride ion will etch the surface of the aluminum being coated, producing a dull, frosty surface and impairing the corrosion resistance and adherence of the coating, the level of free fluoride ion (and hence dissolved aluminum) must be limited. The precise upper limits will have to be determined on a case by case basis, since the degree of etching is dependent upon solution pH, temperature and other parameters. However, preferably no more than about 0.200 grams/liter of free fluoride should be present and preferably the upper limit will not exceed about 0.150 grams/liter. In practice, it has been found that the bath will begin clouding up when the fluoride level drops too far, due to the precipitation of zirconium and aluminum compounds, signaling that more fluoride must be added.

Zirconium conversion coatings of the prior art have typically have been applied from coating solutions maintained at pH's in excess of 3.0. The improved zirconium conversion coatings of the present invention, in contrast to this, are applied from solutions maintained at pH's below about 3.0, preferably below about 2.5 and most preferably below about 2.0. This is made possible by the introduction of nickel ions into the coating composition of the present invention. The added nickel ions are believed to encourage coating formation by facilitating the reaction at the interface between the aluminum surface and the coating solution and by controlling the rate of aluminum removal which might otherwise occur in this acidic environment.

In addition to making possible the formation of improved coatings, the unusually low pH's maintained in the present coating solutions enable the solutions to act as secondary cleaners, potentially aiding or replacing the acidic cleaners which typically precede the coating bath in the metal processing line. Thus, in a single step, the present solutions can remove both smut and oxide from the aluminum surface while depositing the desired conversion coating.

The nickel ions which are believed to make possible the unusually low working pH range of the present coating solutions may be introduced to the solutions in the form of a soluble nickel salt, such as nickel nitrate, nickel fluoborate or nickel fluoride. The minimum level of nickel is about 0.025 grams/liter and preferably about 0.075 grams/liter. The nickel maximum preferably will be about 0.200 grams/liter and more preferably about 0.150 grams/liter.

The present coating composition optionally includes a source of phosphate. The phosphate contributes to the corrosion resistance and adherence of the conversion coatings. It also permits a fairly simple test to be performed to confirm the presence of the nearly invisible conversion coating on the surface of aluminum treated with the present coating solutions.

This test, which has become a standard of the industry, is generally referred to as the "muffle test" since it is performed in a muffle furnace. The muffle test relies upon the fact that conversion coatings containing zirconium and phosphorus will change from clear to a color varying between light golden brown to dark brown or purple when subjected to high temperatures for a short period of time. In this test, the absence of zirconium and phosphorus is indicated by the formation, upon heating of the uncoated surface, of a dull grayish coating.

Satisfactory results may be obtained in the muffle test by introducing as little as 10 ppm by weight of phosphate to the coating solution. However, higher levels of up to about 100 ppm are desirable. Excessive phosphate concentrations should, however, be avoided, because they produce porous coatings and hence reduce corrosion resistance in the conversion coatings.

In the present invention, when phosphate is used it is preferred that it be used in the form of a fluorophosphate compound such as an alkali or alkaline earth metal fluorophosphate. These fluorophosphate compounds form stable, soluble fluorophosphate complexes with the nickel and zirconium ions present in the bath. This results in an extremely stable solution since the formation of insoluble zirconium phosphates precipitates often encountered in prior phosphate-containing zirconium solutions is avoided.

When fluorophosphate compounds are used, they will be present at a minimum level of about 0.050 grams/liter and a maximum level of about 0.50 grams per liter. More preferably, the fluorophosphate level will range between about 0.100 and about 0.150 grams/liter.

The coating solutions of the present invention also optionally include a wetting agent to improve wetting at the interface of the aluminum surface and the solution, to insure uniform coating formation. A properly chosen wetting agent will also improve the adhesion characteristics of the coating and will chelate dissolved aluminum from the bath thereby enhancing the bath stability during continuous processing of aluminum. Certain polyhydroxy compounds have been found to satisfy all of these criteria.

Furthermore, it has been found that under certain conditions polyhydroxy compounds will permit a somewhat muted muffle test to be performed in the absence of the optional phosphate component. This may be important where a water-borne overlying coating is to be applied to the conversion coating because some water-borne coatings adhere better to phosphate-free conversion coatings. Where the overlying coating is not sensitive to phosphate, as is the case for solvent-borne coatings, however, it is preferable to include phosphate because of the more striking muffle test color change obtained with phosphate containing solutions.

If a polyhydroxy material is used, it may be in the form of any water-soluble polyhydroxy compound having up to seven carbon atoms as well as any compound which forms such a polyhydroxy compound when dissolved in water. Typical such compounds include sodium glucoheptonate, gluconic acid, alkali metal, alkaline earth, amine and ammonium salts of gluconic acid, sorbitol, mannitol, dextrose, ethylene glycol and glycerine. Among these, sodium glucoheptonate is particularly preferred.

When polyhydroxy compounds are utilized, they should be present at a level of at least about 0.050 grams/liter and preferably at least about 0.075 grams/liter. The maximum level should not exceed about 0.200 grams/liter and preferably should not exceed about 0.150 grams/liter.

The pH of the solution should be within the range of about 1.2 to about 3.0, preferably within the range of about 1.5 to about 2.5 and most preferably in the range of about 1.5 to about 2.0. These pH ranges reduce the loss of essential components due to precipitation, as encountered in prior baths operating at higher pH's, and, perhaps more importantly, produce conversion coatings with outstanding adhesion and corrosion resistance. The pH of the solution may be adjusted by using appropriate amounts of nitric acid or any other inorganic acid which will not interfere with the coating process.

The temperature of the solution should be adjusted to the broad range of about 80° F. to 150° F., and preferably to the narrower range of about 110° F. to 130° F. before application to the aluminum surface.

In order to obtain an optimal conversion coating, it is important that the surface of the aluminum be cleaned and degreased prior to application of the present coating solution. Two types of cleaners are typically employed in the industry to achieve the necessary cleaning and degreasing, alkaline cleaners operating in the pH range of 9–14 and acid cleaners operating in the pH range of 1.2–1.5. In view of the unusually low pH operating range of the present coating solutions, in applications where acid cleaning is desired, it may be possible to either eliminate the separate acid cleaning operation prior to coating, or at least to reduce the length of the cleaning operation.

In addition, where alkaline cleaning is employed prior to the application of the coating solution, as in the presence practice of the aluminum coil industry, the present invention provides yet another benefit. In such operations, the alkaline cleaning causes the formation of a film of smut consisting of oxides of aluminum and alloying constituents such as magnesium and manganese. Smut impairs the adhesion of the conversion coating and should be removed prior to coating. The present coating solution, due to its unusually low pH operating range will remove the smut as part of the coating operation and without requiring a separate smut removal step.

The present coating solutions may be applied by any suitable method including spraying, misting, immersion, roll and flow coating techniques. The solution can be applied to individual articles such as cans, as well as to aluminum coil which is then fabricated into individual articles after application of the conversion coating.

The thickness of the coating which is put down on the aluminum surface is a function of the contact time as well as other solution parameters, such as temperature, pH and concentration. Typically, coatings of about 2 to about 20 mg/sq. ft. and preferably about 5 to about 10 mg/sq. ft. are desired. Although the contact times necessary to produce these coating thicknesses will have to be determined on a case by case basis, in general coating times of from about 3 to about 10 seconds will be required. In some systems, such as in drawn and ironed can body processing systems, however, coating times of about 10 to about 30 seconds or more may be used.

Once the coating solution has been applied to the aluminum surface, it is rinsed with water and dried by conventional means, such as by passing the coated aluminum through an oven. An overcoat of paint, ink, lacquer or plastic resin, either water or solvent borne, may then be applied by conventional means.

Coating solutions of the present invention may be prepared by simply dissolving the necessary compounds in water and then adjusting the pH. A concentrated solution may be first prepared, and then diluted, if desired.

When the coating solution is utilized in a continuous coating operation, it is necessary to replenish depleted solution components. This may be accomplished by monitoring each ingredient in the solution and replenishing individual ingredients as required, or, it may be accomplished by adding a replenishment solution at the required intervals.

A typical coating solution of the present invention may be prepared by adding the following ingredients to water, including the indicated nitric acid to achieve a pH in the range of 1.5–2.0:

| Compound | Quantity |
|---|---|
| Potassium Zirconium Fluoride | 0.15 grams/liter |
| Nickel Nitrate, Hexahydrate | 0.5 grams/liter |
| Sodium Fluorophosphate | 0.16 grams/liter |
| Sodium Glucoheptonate | 0.10 grams/liter |
| Hydrofluoric Acid (50%) | 0.25 grams/liter |
| Nitric Acid (70%) | 2.10 grams/liter. |

The above solution should be adjusted to a temperature in the range of 100°–130° F. to obtain optimal conversion coating characteristics.

Another typical solution falling within the teaching of the present invention is described in Example 1. This solution contains fluoboric acid in lieu of the hydrofluoric acid of the above solution. Fluoboric acid may be used in lieu of hydrofluoric acid in make-up solutions (as in Example 1) to avoid excessive free fluoride activity at the start-up of the coating operation. As coating proceeds, however, the more active hydrofluoric acid usually will be employed to maintain the desired rate of aluminum dissolution, to control aluminum build-up, and to reduce or prevent precipitation of zirconium and nickel compounds.

In practice, the present coating solutions will be made up from a concentrate containing concentrations of about fifty times of the above compounds. A concentrate of the above coating solution would contain:

| Compound | Quantity |
|---|---|
| Potassium Zirconium Fluoride | 7.5 grams/liter |
| Nickel Nitrate, hexahydrate | 25.0 grams/liter |
| Sodium Fluorophosphate | 8.0 grams/liter |
| Sodium Gluocoheptonate | 5.0 grams/liter |
| Hydrofluoric Acid (50%) | 12.5 grams/liter |
| Nitric Acid (70%) | 105.0 grams/liter |

This concentrate is added to water on a 2% by volume basis.

The following examples are presented in order to illustrate the present invention, and are not intended to be limiting or exhaustive thereof.

EXAMPLES

EXAMPLE 1

The adhesion properties and flexibility of a conversion coating produced in accordance with the present invention were examined in the tests described in this example. The coating solution and application parameters were as follows:

| | |
|---|---|
| Nickel nitrate hexahydrate | 0.40 grams/liter |
| Potassium zirconium fluoride | 0.24 grams/liter |
| Sodium glucoheptonate | 0.10 grams/liter |
| Sodium fluorophosphate | 0.15 grams/liter |
| Fluoboric acid (50%) | 0.10 grams/liter |

pH adjusted with nitric acid to the range of 1.5–2.0.

In these tests, conversion coated aluminum panels of 5050 Alloy were prepared as follows:

(1) Low temperature alkaline cleaner adjusted to 120° F. sprayed for five seconds;

(2) Tap water rinse for five seconds;

(3) Above coating solution adjusted to 120° F. and sprayed for four seconds;

(4) Tap water rinse for five seconds;

(5) Acid rinse (pH 3.5–4.5) for five seconds (optional post-passivating treatment to improve adhesion of certain coatings which appear to bond more efficiently to acidic surfaces);

(6) Air dry; and (7) Apply Mobil S-9009-105 solvent-borne white modified vinyl coating for drawn can interiors according to coating specifications. "Cleaned only" panels were also prepared, by utilizing steps 1, 2, 6 and 7 and the following test performed on both the conversion coated and the "cleaned only" panels:

Boiling Water Test

In this test of adhesion, panels were immersed in boiling tap water containing approximately 6–7 grains of hardness for 15 minutes. The panels were then dried and cross-hatched using a sharp metal object to expose lines of aluminum through the coating. Scotch brand transparent tape No. 610 (3-M Company) was applied to the cross-hatched area and then drawn back against itself in a rapid pulling motion with the object of removing poorly adhered portions of the coating. The results of the test were rated from 10 (no overcoat removal) to 1 (complete removal of overcoat).

Wedge Bend Test

This is a flexibility test which measures the ability of a conversion coated and painted panel to withstand cold deformation. In this test, panels are bent 180° about a mandrel and then paint adhesion is determined by applying and removing Scotch brand tape No. 610 from the bent and adjacent flat areas of the panels, as is done in the Boiling Water Test. The results of this test are rated as follows:

5—No removal;
4—Slight removal;
3—Removal of less than 1/16 inch from flat surface;
1—Complete failure.

Dry Adhesion Test

This test is conducted in the same manner as the above Boiling Water Test, except that the panels are not actually immersed in boiling water. The rating system is identical to that employed in the Boiling Water Test.

Autoclave Test

In this test, the panels are heated in an autoclave to 250° F. under 15 pounds of pressure for 90 minutes whereupon the cross-hatch/scotch tape adhesion test described in connection with the Boiling Water Test is performed. The rating system in this test is again the system of the Boiling Water Test.

Draw-Redraw Can Forming Tests

In these tests, separate painted panels are drawn and redrawn into a container using a Tinius-Olsen Cup and then subjected to the Boiling Water, Dry Adhesion and Autoclave Tests described above. The results with both panels and drawn cups are set forth in Table I below:

TABLE I

PAINT ADHESION STUDIES

| | | Boiling Water Test | Wedge-bend Test | Dry Adhesion Test | Auto-clave Test |
|---|---|---|---|---|---|
| (A) | Panels | | | | |
| | "Cleaned only: | 5 | 1 | 10 | 5 |
| | Cleaned and Conversion Coated | 10 | 5 | 10 | 10 |
| (B) | Drawn Cups | | | | |
| | "Cleaned only" | 1 | 1 | 1 | 1 |
| | Cleaned and Conversion Coated | 10 | 5 | 10 | 10 |

The results reported above demonstrate the excellent adhesion contained with the present conversion coating, under the stressful conditions of the Dry Adhesion, Boiling Water, Wedgebend, and Autoclave Tests of both flat panels and drawn cups.

EXAMPLE 2

In this example, the resistance of conversion coatings of the present invention to heating conditions similar to those experienced in processing conversion coated aluminum cans was examined. The test employed, known as the "TR-3 Test" was developed by Reynolds Metals Company to measure resistance to discoloration in a controlled, simulated hard water. This test was performed upon test panels prepared as described in Example 1 above, using the coating solution set forth in that example.

In the TR-3 Test, the substrate is immersed in a solution of deionized water containing 0.220 grams/liter of sodium bicarbonate and 0.082 grams/liter of sodium chloride for a period of 30 minutes. The solution is maintained at a temperature of 150±5° F. during the immersion. The test results are rated as follows:

| | |
|---|---|
| 10 | No blackening |
| 7–8 | Slight blackening (acceptable) |
| 0 | Heavy blackening (failure) |

The results obtained in the TR-3 Test are reported in Table II below.

TABLE II

TR-3 TEST RESULTS

| Substrate | TR-3 Rating |
|---|---|
| "Cleaned only" panels | 1* |
| Cleaned and conversion coated panels | 10 |

*The "cleaned only" substrate exhibited black and/or brown discoloration after only a few minutes of immersion.

These test results demonstrate that conversion coatings according to the present invention easily pass the TR-3 Test.

EXAMPLE 3

This example was concerned with examining the degree of corrosion resistance achieved in a panel, conversion coated according to the teaching of the present invention, and conventionally overcoated. Adhesion and cure of the overcoating was also examined.

Flat panels of continuous cast Alloy 3105 aluminum, which is typically used as an architectural stock for building products, were used in the tests of this example. The panels were treated in the manner described in Example 1, except that the overcoat was a Whittaker one-coat solvent base (98W233) paint. A Boiling Water Adhesion Test was conducted, along with the T-Bend, MEK Rub, EPCO Pucker and Salt Spray tests. The latter four tests will now be described.

T-Bend Test

This is a test for paint adhesion in which a panel is bent back 180° onto itself. Paint adhesion is then determined using a Scotch tape pull test as described in the Boiling Water Test of Example 1. Results are rated from 10, representing 100 percent adhesion, to 1 representing total failure.

MEK Rub Test

This test is a measure of coating adhesion and cure of a paint. In this test a cloth soaked with methyl ethyl ketone is rubbed back and forth over the painted surface. If the painted surface can withstand 100 or more back and forth rubs, it is rated acceptable.

EPCO Pucker Test

In this test a few drops of a full strength paint stripper, such as Ensign Epoxy Stripper 803, are placed on a painted panel and the time that it takes for the paint to blister or pucker is observed and recorded. Reistance to blistering or puckering of at least 60 seconds are required to pass this test.

Salt Spray Test

This is a standard ASTM (No. B-117-73) in which test specimens prepared by scribing a set of crossed lines through the coating surface are subjected to a salt fog consisting of 5% by weight solution of sodium chloride at a temperature of 95° F. for 1000 hours and rated according to ASTM D1654-Evaluation of Painted or Coated Speciments Subjected to Corrosive Environments.

The results of the above test are reported in Table III. The results demonstrate that conversion coatings of the present invention produce outstanding corrosion resistance as well as paint adhesion.

EXAMPLE 4

In this example, a surface analysis of conversion coatings prepared in accordance with the present invention was made in order to establish the presence of nickel and zirconium in the coating. Aluminum Alloy 5182 panels were prepared and coated in accordance with the procedure of Example 1 and then analyzed using an Ion Probe mass analyzer. The results are reported in Table IV.

The results reported in Table IV show the expected levels of zirconium (including zirconium oxide) and nickel in the cleaned and conversion coated panels. The increases in calcium, silicon, and sodium are believed to be due to impurities in the makeup water of the coating solution. Finally, the decrease in magnesium is believed to be due to the desmutting capability of the solutions of the present invention.

TABLE III

| CORROSION RESISTANCE RESULTS | | | | | |
|---|---|---|---|---|---|
| Panel | T-Bends | MEK Rubs | Boil Water Adhesion | EPCO Pucker Test | Salt Spray |
| "Cleaned only" | 1 | 20 | 8 | blisters in 10 seconds | Fail |
| Cleaned and Deoxidized* | 1 | 20 | 8 | blisters in 10 seconds | Fail |
| Cleaned and Conversion coated | 8 | 100+ | 10 | No loss in 90 seconds | Pass |
| Cleaned, Conversion coated and subjected to a post passivating final acid rinse | 10 | 100+ | 10 | No loss after 5 minutes | Pass |

*Panel was deoxidized in a separate acid rinse at pH 1.2–2.0 before applying the paint.

TABLE IV

| ION PROBE SURFACE ANALYSIS | | | |
|---|---|---|---|
| SURFACE ELEMENTS | MASS | "CLEANED ONLY" PANELS ATOM % | CLEANED AND CONVERSION COATED PANELS ATOM % |
| C | 12 | 5.09 | 7.41 |
| F | 19 | 1.45 | 12.80 |
| Na | 23 | 1.90 | 6.51 |
| Mg | 24 | 47.88 | 1.71 |
| Al | 27 | 41.58 | 48.89 |
| Si | 28 | 0.56 | 0.89 |
| P | 31 | 0.41 | 9.04 |
| Ca | 40 | 0.29 | 0.58 |
| Fe | 56 | 0.06 | 0.89 |
| Ni | 60 | 0.06 | 0.33 |
| Zr | 90 | 0.00 | 6.91 |
| $ZrO_2$ | 106 | 0.00 | 4.05 |

The increased pressure of nickel in the conversion coating is the key data obtained in this example, since it shows that the nickel is an integral component of conversion coatings prepared in accordance with the present invention.

EXAMPLE 5

In this example, the effect of utilizing nickel in the present invention is examined.

Two sets of aluminum panels (Alloy 5182) are prepared generally in accordance with the procedure of Example 1, utilizing the following two coating solutions:

| | Bath Conc. |
|---|---|
| Solution A (with nickel): | |
| Nickel nitrate, hexahydrate: | 1.10 g/l |
| Potassium Zirconium Fluoride: | 0.24 g/l |
| Sodium glucoheptonate: | 0.10 g/l |
| Sodium Fluorophosphate: | 0.15 g/l |
| Fluoboric acid: | 0.10 g/l |
| pH adjusted with nitric acid | |
| Solution B (without nickel): | |
| Potassium Zirconium Fluoride: | 0.20 g/l |
| Sodium gluconate: | 0.10 g/l |
| Phosphoric acid: | 0.10 g/l |
| Fluoboric acid: | 0.10 g/l |
| Hydrofluoric acid: | 0.15 g/l |
| pH adjusted with nitric acid | |
| Temperature: 120° F. | |
| Spray: 5–6 seconds | |

The above panels are subjected to the TR-3 and Wedgebend Tests described in Example 1 as well as the "Dowfax Adhesion Test." In the Dowfax Adhesion Test, a solution containing five ml. of Dowfax 2A1 (a solution of the sodium salt of disulfonated dodeyl diphenyl oxide), in 3 liters of deionized water is prepared. Panels painted with Mobil #78x223, one coat, modified vinyl solvent-based coating for soft drink ends are immersed in boiling Dowfax solution for 15 minutes and then rinsed in tap water and dried. The resulting panels are then crosshatched and subjected to a Scotch tape test in accordance with the boiling water of Example 1 and rated on a scale between 10 (no paint removal) to 1 (complete paint removal).

The results of the test performed in this example are reported in Table V.

The data reported in Table V demonstrate that nickel containing baths produce outstanding conversion coatings when compared to a corresponding nickel free bath, particularly in the low pH operating range of the present invention.

EXAMPLE 6

In this example an examination was made of the performance of test panels prepared in accordance with the present invention in the muffle test.

Aluminum alloy panels (Alloys 3004, 5182 and 5050) were prepared as described in Example 1 using conversion coating baths at pH's between 1.0 and 3.0 and operating at coating temperatures between 80° F. and 125° F.

The coated panels were exposed to about 1000° F. for three to five minutes in a muffle furnace. All of the treated panels turned yellow to brown or purple in color, indicating the presence of the desired conversion coating. The color produced depended upon the relative amount of conversion coating. Cleaned but untreated panels showed no change of color in the muffle test.

EXAMPLE 7

In this example, the amount of nickel and zirconium extractable from conversion coatings produced in accordance with the present invention was examined.

TABLE V

| | EFFECT OF NICKEL | | | |
|---|---|---|---|---|
| Panel Treatment | pH | TR-3 | Dowfax Adhesion | Wedgebend |
| "Cleaned Only" | — | 1 | 1 | 2 |
| Cleaned and treated with Solution A | 1.2 | 7 | 8 | 5 |
| | 1.5 | 9 | 10 | 5 |
| | 2.0 | 10 | 10 | 5 |
| | 3.0 | 9 | 2 | 4 |
| Cleaned and treated with Solution B | 1.2 | 2 | 2 | 2 |
| | 1.5 | 8 | 2 | 5 |
| | 2.0 | 10 | 5 | 5 |
| | 3.0 | 10 | 8 | 5 |

The test procedure entailed preparing three sets of test panels as described in Example 1 and refluxing one set in deionized water for 24 hours, one in acetic acid (0.01 M) for 30 minutes and one in ethanol (8%) for 30 minutes. These extraction tests, which were each performed in triplicate to insure reproducibility, showed that no detectable amounts of metal (zirconium or nickel) were found in the extraction liquid.

The present invention constitutes an important contribution to the art of zirconium conversion coating. It permits the coating process to be carried out more efficiently than has hitherto been possible. It also permits the formation of conversion coatings exhibiting outstanding corrosion resistance and flexibility. Finally, it exhibits an unusual and potentially very significant capacity to clean and coat aluminum and aluminum surfaces in a one step operation.

What we claim is:

1. An aqueous coating solution for forming a coating on aluminum and aluminum alloy surfaces consisting essentially of at least about 0.025 grams/liter of zirconium, at least about 0.050 grams/liter of fluoride ion, at least about 0.025 grams/liter of nickel and sufficient acid to adjust the pH to the range of about 1.2 to about 2.5.

2. An aqueous coating solution as in claim 1 including at least 10 ppm by weight of phosphate.

3. An aqueous coating solution as in claim 1 including at least about 0.050 grams/liter of fluorophosphate.

4. An aqueous coating solution as in claim 1, 2 or 3 including at least about 0.050 grams/liter of a polyhydroxy compound having up to 7 carbon atoms.

5. An aqueous coating solution as in claim 4 wherein said polyhydroxy compound is sodium glucoheptonate.

6. An aqueous coating solution as in claims 1, 2 or 3 wherein said zirconium is present at a level of at least about 0.08 grams/liter, said fluoride is present at a level of at least about 0.100 grams/liter and said nickel is present at a level of at least about 0.100 grams/liter.

7. An aqueous coating solution as in claim 1, 2 or 3 wherein said pH is adjusted to the range of about 1.5 to about 2.0.

8. An aqueous coating solution for forming a protective, flexible coating on aluminum and aluminum alloy surfaces consisting essentially of from about 0.05 to about 0.120 grams/liter of zirconium, from about 0.100 to about 0.150 grams/liter of fluoride, from about 0.075 to about 0.150 grams/liter of nickel, from about 0.100 to about 0.150 grams/liter of a fluorophosphate compound, from 0.075 to about 0.150 grams/liter of a polyhydroxy compound having up to 7 carbon atoms and sufficient acid to adjust the pH of the solution to the range of about 1.5 to about 2.0.

9. A method for coating aluminum and aluminum alloy surfaces comprising contacting said surfaces with an aqueous coating solution consisting essentially of at least about 0.025 of zirconium, at least about 0.050 of fluoride, at least 0.025 of nickel and sufficient acid to adjust the pH of said solution to the range of about 1.2 to about 2.5.

10. A coating method as in claim 9, wherein said pH is adjusted to the range of about 1.5 to about 2.0.

11. A coating method as in claim 9 wherein the temperature of said coating solution is adjusted to the range of about 80° F. to about 150° F.

12. A coating method as in claim 9 wherein the temperature of said coating solution is adjusted to the range of about 110° F. to about 130° F.

13. A coating method as in claim 9 wherein said surfaces are cleaned with an alkaline cleaner before said surfaces are contacted with said coating solution.

14. A coating method as in claim 9, 10, 11, 12 or 13 wherein said surface is contacted with said coating solution for from about 3 to about 10 seconds.

15. A coating method as in claim 9, 10, 11, 12 or 13 wherein said surface is contacted with said coating solution for from about 10 to about 30 seconds.

* * * * *